United States Patent [19]

Crossfield

[11] Patent Number: 4,664,339

[45] Date of Patent: May 12, 1987

[54] MISSILE APPENDAGE DEPLOYMENT MECHANISM

[75] Inventor: Philip M. Crossfield, Huntsville, Ala.

[73] Assignee: The Boeing Company, Seattle, Wash.

[21] Appl. No.: 660,866

[22] Filed: Oct. 11, 1984

[51] Int. Cl.[4] ..... F42B 13/32

[52] U.S. Cl. ..... 244/3.28; 244/3.29

[58] Field of Search ..... 244/3.28, 3.29, 3.27; 102/385, 388

[56] References Cited

U.S. PATENT DOCUMENTS

| | | | |
|---|---|---|---|
| 3,063,375 | 11/1962 | Hawley et al. | 244/3.29 |
| 3,098,445 | 7/1963 | Jackson | 244/3.28 |
| 3,127,838 | 4/1964 | Moratti et al. | 244/3.28 |
| 3,185,097 | 5/1965 | Cushing et al. | 244/3.28 |
| 3,695,556 | 10/1972 | Gauzza et al. | 244/3.28 |
| 4,209,146 | 6/1980 | Mattson | 244/3.27 |
| 4,323,208 | 4/1982 | Ball | 244/3.28 |

*Primary Examiner*—Deborah L. Kyle
*Assistant Examiner*—Michael J. Carone

[57] ABSTRACT

A missile appendage deployment mechanism for receipt on the side of a missile or projectile and in a stowed position. The mechanism including a wing or fin which is designed, when deployed, to rotate upwardly from the stowed position into a feathered vertical position into the airstream of the missile. The wing moves upwardly from the horizontal stowed position into the vertical feathered position in a continuous smooth motion.

7 Claims, 5 Drawing Figures

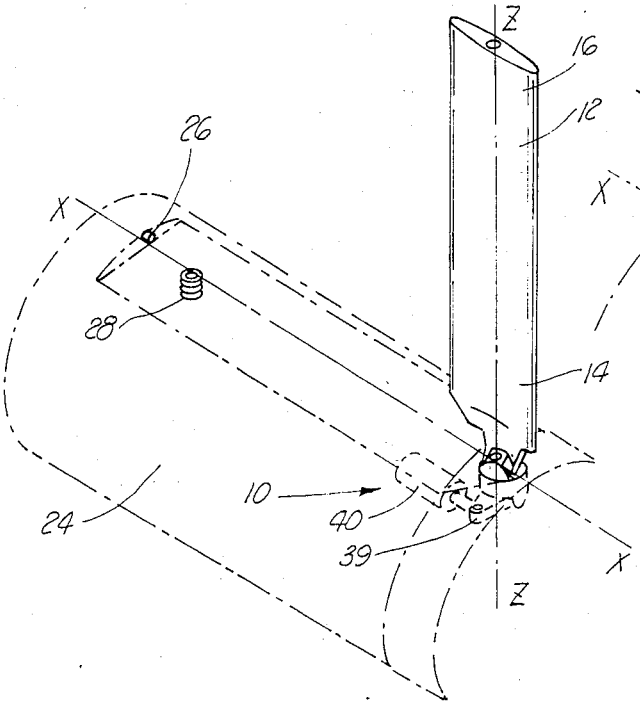
FIG. 3
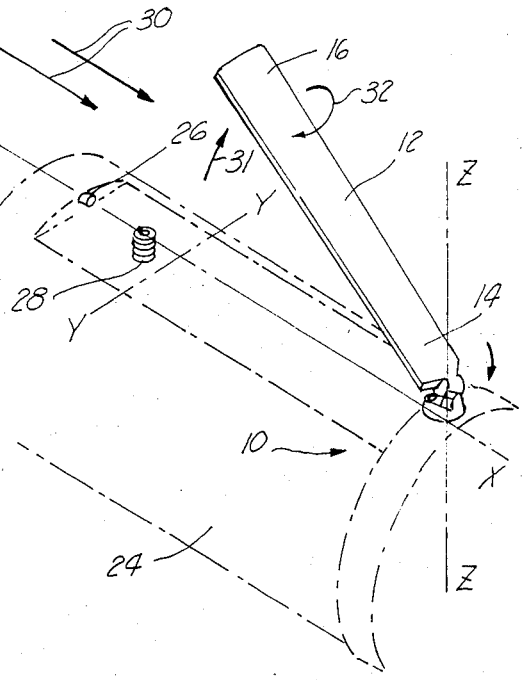
FIG. 2
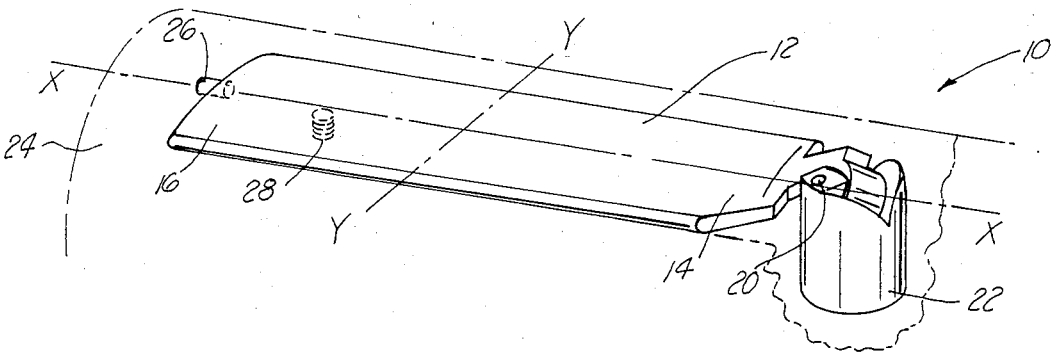
FIG. 1
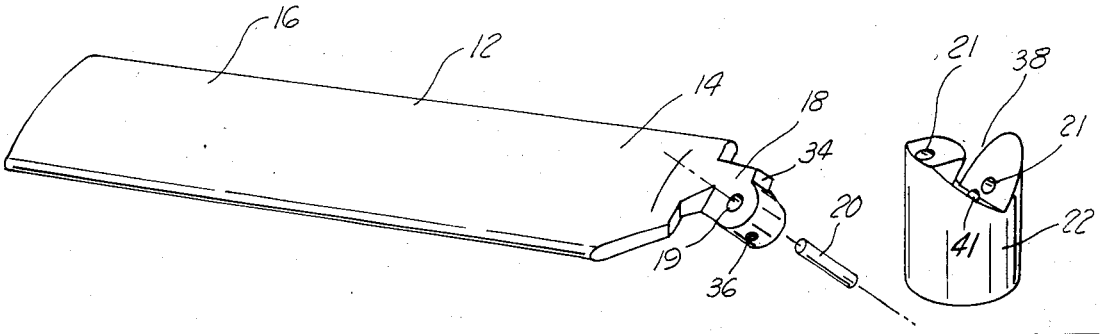
FIG. 4
FIG. 5

MISSILE APPENDAGE DEPLOYMENT MECHANISM

BACKGROUND OF THE INVENTION

The subject invention provides a hinged wing for controlling the flight of a missile and more particularly but not by way of limitation to a wing which is stowed along the side of the missile in a X-Y horizontal plane and when released into the airstream of the missile, rotates upwardly into an X-Z vertical plane so the wing is feathered into the airstream of the missile.

Heretofore, there have been various types of wing and fin deployment mechanisms described in the following United States Patents. They are: U.S. Pat. No. 3,063,375 to Hawley et al, U.S. Pat. No. 3,127,838 to Moratti el al, U.S. Pat. No. 3,602,459 to Pesarini, U.S. Pat. No. 3,986,684 to Marburger et al, U.S. Pat. No. 3,986,685 to Marburger et al, U.S. Pat. No. 3,998,407 to Marburger et al and U.S. Pat. No. 4,175,720 to Craig. None of the prior art patents specifically describe the unique features and advantages of the subject missile appendage deployment mechanism as described herein.

SUMMARY OF THE INVENTION

The missile appendage mechanism provides a means for deploying a wing or fin of a missile from a stowed position along the side of the missile to a deployed position in the airstream of the missile.

The invention provides the unique feature of using a single pivot, the axis which is aslant to the wing axis and the missile axis, for pivoting the wing from a stowed position along the side of the missile in which the wing chord plane is parallel to the missile centerline, to a deployed position in which the wing chord plane passes through the missile centerline and parallel to the missile centerline.

The mechanism is simple in design and can be easily adapted for different types of missiles and the like for controlling the flight of the missile during its operation. Deployment of the wing can be initiated upon command of an autopilot or upon release of a restraining mechanism.

The design of the missile appendage deployment mechanism allows use of wings with higher aspect ratios than the flat or curved wings hinged and stowed along the side of the missile. This design eliminates requirement of slots in the missile body to stow flat wings, thus providing more volume for packaging controls and payload.

The missile appendage deployment mechanism for receipt along the side of a missile and controlling its flight includes a wing having a lug integrally formed in one end thereof. The wing is disposed in a X-Y horizontal plane parallel to the centerline of the missile. A clevis is attached to the missile and hinged to the lug of the wing and the hinge is disposed at an angle to the X-Y horizontal plane and at an angle to the X-Z vertical plane along the centerline of the missile. A restraining pin or other device is used for holding the wing against the side of the missile prior to the deployment of the wing. A compression coil spring or any similar type of biasing means may be used for urging the wing upwardly into the airstream of the missile when the wing is deployed. The wing, with lug, pivots about the hinge axis on the clevis upwardly into a vertical position and at the same time rotates from the X-Y horizontal plane into the X-Z vertical plane which passes through the missile centerline, or may be offset and parallel to the missile centerline so the wing is feathered into the airstream.

The advantages and objects of the invention will become evident from the following detailed description of the drawings when read in connection with the accompanying drawings which illustrate preferred embodiments of the invention.

BRIEF DESCRIPTION OF THE DRAWINGS

FIG. 1 illustrates the appendage deployment mechanism in a stowed position.

FIG. 2 illustrates the wing being released by the restraining pin and being urged upwardly into the airstream.

FIG. 3 illustrates the wing in a complete vertical deployed position with the wing feathered into the X-Z vertical plane which passes through or may be parallel to the centerline of the missile.

FIG. 4 illustrates the structure of the wing and lug with hinge pin.

FIG. 5 illustrates the structure of the clevis.

DETAILED DESCRIPTION OF THE DRAWINGS

In FIG. 1 the missile appendage deployment mechanism is illustrated by general reference numeral 10. The missile 10 includes a wing 12 having a first end portion 14 and a second end portion 16. The first end portion 14 includes an integrally formed lug 18 having an aperture 19 therethrough for receiving a hinge pin 20 therethrough. The aperture 19 and pin 20 can be seen more clearly in FIG. 4. The pin 20 is also received through aperture 21 in a clevis 22. The clevis 22 is mounted vertical inside a missile 24. In FIG. 1 the plane of the wing 12 is disposed in an X-Y plane parallel to missile centerline and against the side of the missile 24. The X axis is also parallel to the centerline of the missile 24. The wing 12 is held in this stowed position by a restraining pin 26 mounted in the side of the missile 24 and engaging the second end portion 16 of the wing and holding the wing 12 in its stowed position.

At some predetermined time during flight, the locking pin 26 using electrical control, inertia released latch, or any similar release mechanism releases the second end portion of the wing 12. Using a compression spring 28 or any similar other biasing means, the spring urges the wing 12 upwardly into the airstream of the missile. At this time, the airstream as shown as arrows 30 in FIG. 2 provides the necessary force for rotating the wing 12 upwardly into a vertical position.

Because the hinge 20 is disposed at an angle in the range of 45 degrees from the X-Y plane and at an angle at approximately 45 degrees from the X-Z plane the wing 12, when released from its stowed position, rotating about pin 20, moves upwardly in an arc from the X-Y plane as indicated by arrow 31 into a deployed position in the X-Z plane. During this motion the wing rotates as indicated by arrow 32 from the X-Y plane into the X-Z plane in one continuous smooth motion, thereby feathering the wing 12 into the airstream of the missile 24. The missile centerline may be an element of the X-Z plane or may be parallel to the X-Z plane.

In FIG. 2, the wing 12 can be seen in a partially deployed position with the wing 12 beginning to rotate from its stowed position, in the X-Y plane, moving in an arc about the pivot pin 20 to the deployed position in the X-Z plane.

In FIG. 3, the wing 12 is shown in a completely deployed position with the wing now in the X-Z plane and feathered into the airstream for controlling the flight of the missile 24. While just one mechanism 10 is shown in the drawings, it should be appreciated that a plurality of the mechanism 10 would be used on various sizes of missiles.

FIG. 4 illustrates the detailed structure of the wing 12 with lug 18 having a lug stop 34 and a detent hole 36. The hinge pin 20 is shown in position for receipt in the aperture 19. As the lug 18 pivots in an angled groove 38 in the top of the clevis 22 as shown in FIG. 5 the stop 34 engages a portion of the clevis 22 when the wing 12 is in a deployed position. At the same time a locking pin 41 in the bottom of groove 38 is biased upwardly into the detent hole 36 for holding the wing 12 in a locked deployed position. The clevis 22 is afixed to the missile body 24 or may be allowed to rotate about the Z axis in the missile body 24. This provides rotational control to the wing 12. Further the rotation of the wing 12 may be controlled by the addition of an arm 39 connected to the clevis 22 and an actuator 40 attached to arm 39. By operating the actuator 40, additional feathering of the wing 12 is provided. The arm 39 and actuator 40 are shown in dotted lines in FIG. 3.

Changes may be made in the construction and arrangement of the parts or elements of the embodiments as described herein without departing from the spirit or scope of the invention defined in the following claims.

What is claimed is:

1. A missile appendage deployment mechanism for receipt against a side of a missile and aiding in the control of the missile's flight, the mechanism comprising:

a wing having a lug integrally formed in one end thereof, the wing disposed in a X-Y plane parallel to a centerline of the missile;

an annular-shaped clevis rotatably attached to the missile and hinged to the lug, the hinge disposed at an angle greater than zero to the X-Y plane and at an angle greater than zero to a X-Z plane through the center of the missile, the clevis rotating about a Z axis through the missile and perpendicular to the X-Y plane;

restraining means for releasable holding the wing against a side of the missile in the X-Y plane;

biasing means for urging the wing upwardly in the airstream of the missile during flight, the wing with lug pivoting on the hinge upwardly into an upright position and rotating from the X-Y plane into the X-Z plane so the wing is feathered into the airstream; and rotation means mounted in the missile and connected to the clevis for additinal feathering of the wing in its upright position.

2. The mechanism as described in claim 1 further including a locking mechanism for holding the wing in place on the clevis when the wing is rotated into the X-Z plane and feathered into the airstream.

3. The mechanism as described in claim 1 wherein the restraining means is a locking pin received in the side of the missile and engaging the other end of the wing when the wing is disposed in the X-Y plane and against the side of the missile.

4. The mechanism as described in claim 1 wherein the biasing means is a coil spring disposed against the side of the missile and against the side of the wing when the wing is held in place by the restraining means.

5. A missile appendage deployment mechanism for receipt against a side of a missile and aiding in the control of the missile's flight, the mechanism comprising:

a wing disposed in a X-Y plane parallel to a centerline of the missile;

an annular-shaped clevis rotatably attached to the missile and hinged to a lug, the hinge disposed at an angle greater than zero to the X-Y plane and at an angle greater than zero to a X-Z plane through the centerline of the missile, the clevis rotating about a Z axis through the missile and perpendicular to the X-Y plane;

a restraining pin disposed in the side of the missile for engaging an other end of the wing for holding the wing against the side of the missile when the wing is in the X-Y plane;

biasing means disposed between the wing and the side of of the missile for urging the wing upwardly into the airstream during flight when the restraining pin has released from the other end of the wing, the wing with lug, pivoting on the clevis upwardly into an upright position and rotating from the X-Y plane upward so the wing is feathered in a single continuous motion into the airstream; and rotation means mounted in the missile and connected to the clevis for additional feathering of the wing in its upright position.

6. The mechanism as described in claim 5 further including a locking mechanism disposed in the clevis for engaging the lug of the wing when the wing is deployed upwardly into the airstream of the missile.

7. The mechanism as described in claim 1 or claim 5 wherein the rotation means is an actuator mounted in the missile and connected to an arm attached to and extending outwardly from the clevis.

* * * * *

UNITED STATES PATENT AND TRADEMARK OFFICE

CERTIFICATE OF CORRECTION

PATENT NO. : 4,664,339

DATED : May 12, 1987

INVENTOR(S) : Philip M. Crossfield

It is certified that error appears in the above-identified patent and that said Letters Patent is hereby corrected as shown below:

Claim 1, column 4, line 4, change "additinal" to --additional--.

Signed and Sealed this

Twenty-seventh Day of October, 1987

*Attest:*

DONALD J. QUIGG

*Attesting Officer*

*Commissioner of Patents and Trademarks*